US005494059A

United States Patent [19]

Barrows et al.

[11] Patent Number: 5,494,059

[45] Date of Patent: Feb. 27, 1996

[54] HAIR STYLING IMPLEMENT AND METHOD

[76] Inventors: David P. Barrows; Debra J. Elowe, both of Clock House, Hay Lane, Shernal Green, Droitwich, Worcester, United Kingdom, WR9 7JS

[21] Appl. No.: 269,659

[22] Filed: Jul. 1, 1994

[30] Foreign Application Priority Data

Nov. 11, 1993 [GB] United Kingdom ..... 9323275
May 6, 1994 [GB] United Kingdom ..... 9409065

[51] Int. Cl.[6] ..... A45D 8/00; A45D 2/00

[52] U.S. Cl. ..... 132/273; 132/275; 132/222; 132/210

[58] Field of Search ..... 132/222, 273, 132/275, 210, 212; D28/41, 35

[56] References Cited

U.S. PATENT DOCUMENTS

| | | | |
|---|---|---|---|
| D. 344,176 | 2/1994 | Lawrence | D2/875 |
| 1,811,842 | 6/1931 | Bossart | 132/273 |
| 4,972,859 | 11/1990 | Noviello, Jr. et al. | 132/273 |
| 4,998,544 | 3/1991 | Obergfell | 132/212 |
| 5,044,385 | 9/1991 | Rhodes | 132/273 |
| 5,067,177 | 11/1991 | Binder | 2/239 |
| 5,097,854 | 3/1992 | Smith | 132/275 |
| 5,156,171 | 10/1992 | Goodman | 132/200 |
| 5,170,509 | 12/1992 | Leopold | 2/199 |
| 5,186,186 | 2/1993 | Hamilton | 132/200 |
| 5,239,705 | 8/1993 | Leopold | 2/209.13 |
| 5,289,834 | 3/1994 | Lawrence | 132/212 |
| 5,303,723 | 4/1994 | Schach | 132/246 |

FOREIGN PATENT DOCUMENTS

| | | |
|---|---|---|
| 0448916A1 | 10/1991 | European Pat. Off. . |
| 480696 | 2/1938 | United Kingdom . |
| 560973 | 4/1944 | United Kingdom . |
| 2266235 | 10/1993 | United Kingdom . |
| WO93/13688 | 7/1993 | WIPO . |

OTHER PUBLICATIONS

Contempo Wrap™ publication authored by the Marketing Group, L.P. of Atlanta, Georgia 30339 ("The Marketing Group") entitled Contempo Wrap™—Styling Instructions made available to public at least as early as 1991 (See Declaration of Arthur S. Damast submitted in support of Protest of Serial No. 08/269,659 pursuant to 37 C.F.R. 1.291(a) at å 9 and Exhibit 5 thereto (hereinafter Damast Decl. at å _).

Hair styling implements product style 935/77/78 sold by Criterion Bead & Novelty Corporation of Woodside, N.Y. ("Criterion") at least as early as 1989 (see Damast Decl. at å 4 and Exhibits 1–A and 1–B thereto).

Hair styling implements product style "Fashion Headband" sold by Criterion at least as early as 1990 (see Damast Decl. at å 7 and Exhibits 3–A, 3–B, 3–C thereto).

Contempo Wrap™ product sold by the Marketing Group at least as early as 1991 (see Damast Decl. at å 8 and Exhibit 4 thereto).

*Primary Examiner*—John G. Weiss
*Attorney, Agent, or Firm*—Greenlee and Winner

[57] ABSTRACT

A hair styling implement 10, which is also sufficiently decorative for it to be worn in the hair after styling as an adornment, is in the form of an elongated, rectangular wire frame 11 of pliable material covered by a fabric 16 such as velour, through which extends a central, elongated opening 17 (FIG. 1). In use, a section of hair 18 is received through the opening and the implement is rolled under or over the hair until the hair is wound tightly about the implement at the scalp, opposite ends of the implement then being brought together and twisted together thereby to secure a bun in place.

9 Claims, 4 Drawing Sheets

HAIR STYLING IMPLEMENT AND METHOD

This invention relates to an implement for styling hair, the implement also constituting a decorative hair accessory, so that it can continue to be worn on completion of the styling and provide an attractive appearance. A method of styling is also described.

BACKGROUND OF THE INVENTION

While there are a wide variety of hair styling implements, these are generally intended to be removed from the hair once the styling operation is complete. On the other hand, although there are many known hair adornments, these generally play no part in styling the hair.

Certain implements, such as decorative combs, are useful for hair styling and if desired may remain in the hair as an adornment. However, such implements take a relatively rigid conformation and are not suitable for both styling the hair and holding the hair style in place for a wide variety of hair arrangements. Combs, and implements such as pins, are designed to receive the user's hair through a configuration of tines that may require a clamping action to hold a section of hair. Such configurations are subject to losing the section of hair intended to be held, and over a time period of use strands of stray hair often appear.

Various hair styling devices have been devised in attempts to solve these problems. U.S. Pat. No. 5,303,723 shows a flexible device capable of producing several hair styles but does not have the ability to positively capture a section of hair. U.S. Pat. No. 5,044,385 relates to a hair styling device for ponytails. U.S. Pat. No. 5,186,186 shows an ornamental device which can retain hair in ponytail, braid or the like styles.

It is the object of the current invention to provide a decorative hair styling implement that receives and retains hair and moreover, an implement that is flexible, bendable and twistable and as such is useful for a wide variety of hair stylings.

It is another object of the invention to provide a hair styling implement that maintains the section of retained hair free of stray strands throughout the period of use.

Another important object is to provide a styling implement that is comfortable and wearable fort extended periods, even while the user is asleep, so that the implement provides the hair with a curly set.

Still another object is to provide a hair styling implement that is easy and quick to use so that hairstyles can be changed easily within the day to reflect the mood of the user without the need for attending a professional salon.

SUMMARY OF THE INVENTION

Briefly stated, the invention is to a decorative hair styling implement and to methods of using the implement for creating various hair styles. The implement for styling a person's hair is characterized by a body of flexible material, such as wire, the body having a non-rigid decorative covering such as velour, and by an enclosed opening in the covering through which at least a section of the person's hair is intended to pass, in use, to enable styling to take place. The covering may contain a tubular pocket along its periphery to hold the body of flexible material in place.

According to a second aspect of the invention a method of styling a person's hair using a styling implement which comprises at least a section of the person's hair to be received through an enclosed opening in the implement, positioning the implement at or near the bottom of said hair received through the opening, rolling the implement under or over said hair to wrap it about the implement, and bringing respective opposite ends of the implement together to secure the implement in place.

BRIEF DESCRIPTION OF THE DRAWINGS

The invention will now be described, by way of example, with reference to the accompanying drawings, in which:

FIGS. 2–4 schematically show respective steps in the styling of a woman's hair using the implement of FIG. 1.

DETAILED DESCRIPTION OF THE INVENTION

Figure 1:
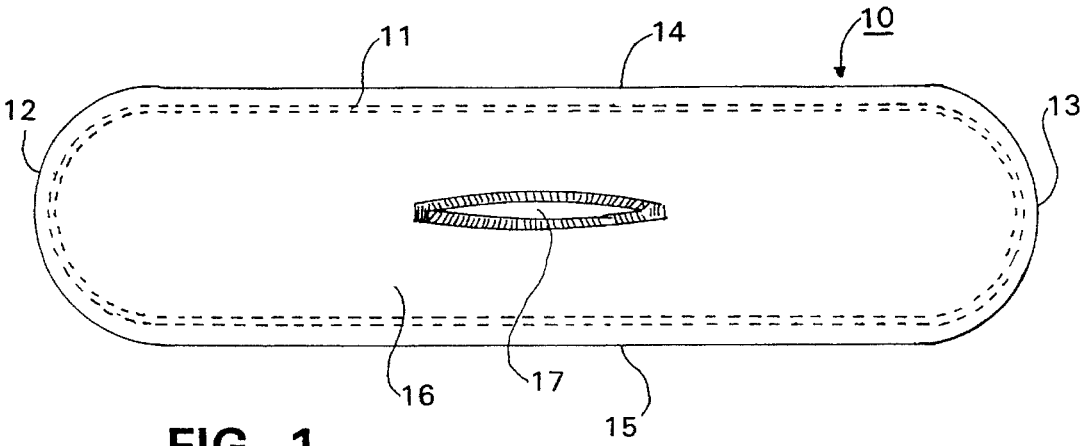
FIG. 1 is a side view of a hair styling implement of the present invention in an initial state.

An implement 10 for styling hair is shown in FIG. 1 in its initial state, the implement having a body formed by a loop of flexible wire 11. Any suitable material can be used for the wire, it merely being necessary that it is pliable so that, as will be described, the implement can be bent, bowed or twisted without breaking, and with little or no tendency for the body to return of itself to its former shape. The wire can be of any cross-section and size consistent with its above mentioned properties. In a convenient embodiment the wire is galvanized and/or covered by a plastics material and is of circular cross-section.

In its initial state the body is preferably shaped as shown in the FIG. 1 embodiment, i.e., it is a continuous frame formed in a rectangular shape with slightly rounded opposite end sections 12 and 13 respectively joining longer straight side sections 14 and 15 respectively. Other body shapes could however be used, although an elongated form is preferred.

The body is enclosed in a non-rigid covering 16 which is, in a preferred embodiment, a fabric. Preferred fabrics are velour, velvet or the like. However other fabrics could be used, as could a non-fabric covering, such as a plastics material with sufficient flexibility to be bent, twisted or bowed, as described, with the body. The covering is preferably to make the implement of decorative appearance, so that, as will be described, the implement can remain in place after it is used for styling hair and be worn as an adornment. Preferably the covering is such that the implement can be hand washed.

The covering is, in the FIG. 1 embodiment, arranged around the wire so that the wire still substantially defines the outer periphery of the implement, although the covering could extend beyond the boundary of the wire, which was secured in place within the covering, for example, by appropriate stitching. In the embodiment illustrated, the stitching could define a tubular pocket around the inner boundary of the covering to contain the wire. The covering can be formed as one or more sections. The covering can, of course, be in any selected color.

At the center of the covering, there is formed a through opening 17, preferably, as shown, of elongated form, lying parallel to the side sections 14 and 15. The opening 17 is formed by any suitable means. It is important that fraying does not occur at the opening and accordingly the opening can conveniently be formed in the same manner as a button hole by sewing along the opposite side to form the hole and then slitting therebetween.

The size and shape of the opening can both separately differ from that shown, although as will be described, with a larger opening, it may, in use, be necessary to twist the opposite ends of the implement in opposite directions so as, in effect, to close up an oversized opening. The opening could be other than central and more than one opening could possibly be provided.

The opening is enclosed, that is, it is always impossible for a section of hair to be passed into it sideways, i.e., in the plane of the opening. In other words, the invention does not relate to an implement which could be formed as or into a U-shape, so that a section of hair could then be passed sideways into the implement between the limbs of the U-shape, the free ends of the limbs being brought together to define an opening in which the hair section is received.

A use of the implement will now be described in relation to FIGS. 2–4.

Firstly, the section of hair 18 to be styled is combed to lie straight down the person's neck and back, and the lower free end thereof is then received through the opening 17 of the implement. By then holding the hair taut the implement 10 can be slid somewhat upwardly. While it may be necessary to gather the section of hair together for it initially to enter the opening, the opening is shaped and sized so that hereafter it allows the hair to spread.

Figure 2:
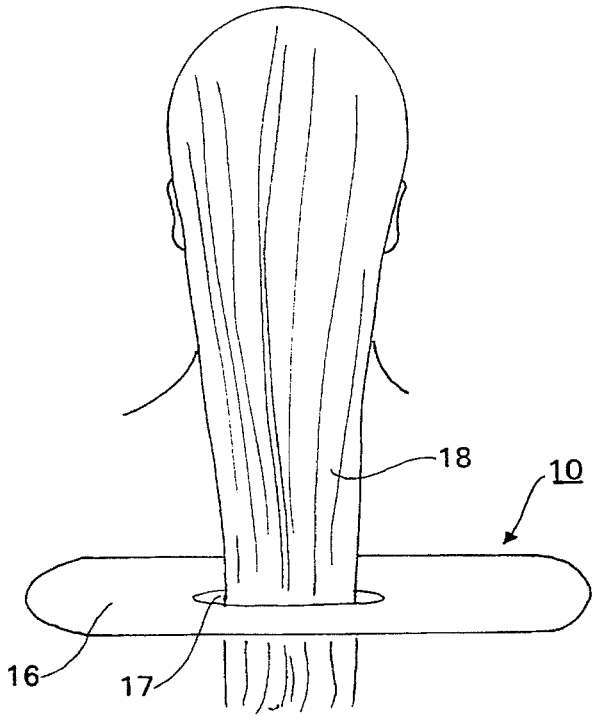

Keeping the implement horizontal, and gripping it with one hand either side, the implement is slid down the hair 18 until it reaches about 5–7.5 mm (2–3 ins), from the bottom, as shown in FIG. 2.

Figure 3:
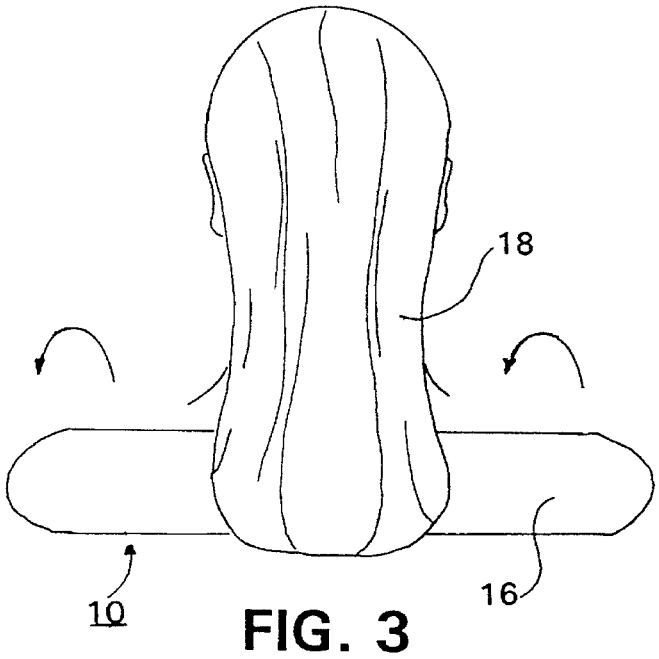

The next step, as shown in FIG. 3, is to roll the implement upwardly under the hair, keeping it horizontal, until the implement has rolled the hair as firmly as possible against the scalp or the nape of the neck, with no further upwards movement being possible. The hair, as a result, is now tightly wrapped around the implement.

Figure 4A:
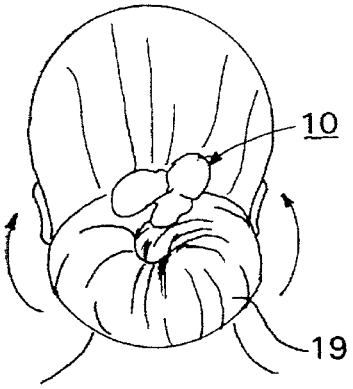
FIG. 4A and 4B each show a completed styling.

Finally, as shown in FIG. 4A, the opposite ends of the implement are brought up to the center and crossed over. The crossed over ends are then intertwined simply by twisting the wire at said ends. The bun 19 formed the styling is thus secured in place in the back of the user's hair. The implement is of sufficiently decorative appearance to allow it to be worn as a decorative hair accessory. Additionally, left in place all night, it will be found that on removal next morning the hair will be curly. The implement is advantageous over known accessories in requiring no catches, pins, clips, grips or zips.

Figure 4B:
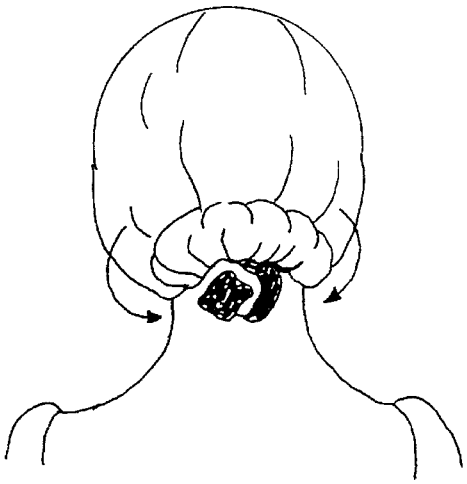

Instead of rolling the implement upwardly under the hair, an alternative method of use is to roll the implement upwardly over the hair. As with rolling under the hair, the procedure for rolling over the hair is carried out until no further upwards movement of the implement is possible. The two ends of the implement are then brought down to the center and crossed over. The crossed over ends are then intertwined simply by twisting the wire within the ends of the implement. The result is similar to that shown in FIG. 4A, but with the decorative, visible part of the implement disposed at the bottom of the bun, as shown in FIG. 4B, instead of at the top thereof, as in FIG. 4A.

Figure 5:
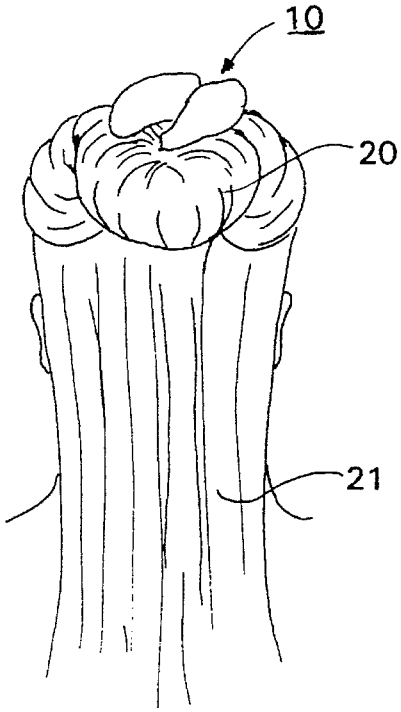
FIG. 5 schematically shows a completed styling, but in the form of a variation where sections of the hair at opposite sides thereof only are styled.
Figure 6:
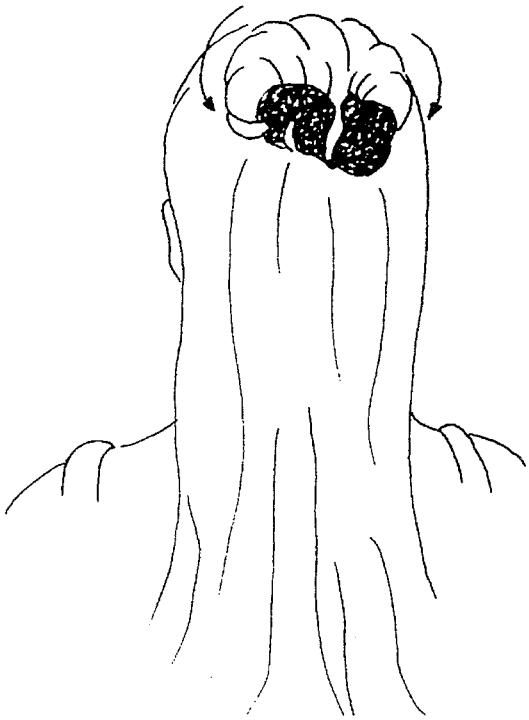
FIG. 6 shows a completed styling which is a variation of the styling shown in FIG. 5.

FIG. 5 relates to a variation in the use of the implement, where instead of all the combed hair shown in FIG. 2 being received through the implement, a hair section of full width but only half thickness, a center hair section comprised only of full or half thickness or a hair section comprised of full or half thickness at opposite sides is or are used. The remainder of the steps are then performed as above to create a bun 20 over the remaining section or sections of hair. FIG. 5 shows the result of rolling the implement under the hair using sections at opposite sides, with the remaining, central section 21 not included in the hair encompassed by the implement. With rolling over the hair, the decorative, visible part of the implement is at the bottom, instead of the top, of the bun. FIG. 5 shows the implement at the top of the "half" bun and FIG. 6 shows the implement at the bottom of the "half" bun.

A variation of any of the alternative FIG. 5 types of use referred to, with the implement being rolled over the hair, involves continuing the rolling process until the rolled over hair is tight. The remainder of the hair is then brought forwards, over the rolled hair wound on the implement. This may be by a manual operation, but preferably, and easiest, it is effected by the user tipping her head forward so that the remainder of her hair falls forward over the wound hair.

Figure 7:
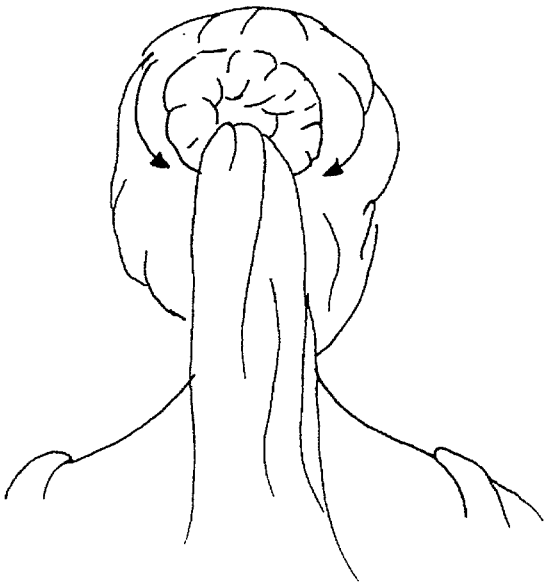
FIGS. 7–9 show still more completed styling hair arrangements.

Still with her head tipped forward, the opposite ends of the implement are then brought together and crossed over. The crossed ends are then intertwined by twisting them together. The result is a bun, as previously described with the FIG. 5 method involving rolling the implement over, rather than under, the section of hair passing through the implement, but with the remainder of the hair in the form of a pony tail, which emerges from the lower inside of the bun and passes over the intertwined ends of the implement. FIG. 7 shows the resulting "pony loop" effect thus created by the loop of the bun and the pony tail extending therefrom.

Figure 8:
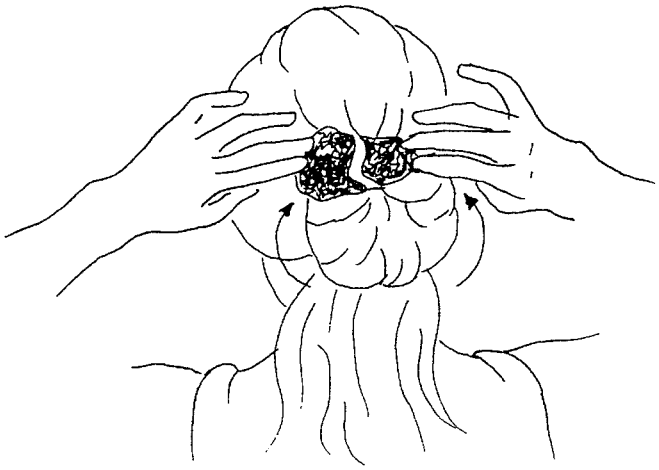

FIG. 8 shows a variation in the use of the inventive implement to produce a "pony bun" hair style. To achieve this style, all of the hair is passed through the opening 17 as shown in FIG. 2. The implement is positioned about half way between the scalp and the far end of the hair. The hair is then rolled around the implement, either over or under, until it is tight to the neck. The two ends 12 and 13 of the implement are then crossed over one another and twisted together to secure the implement in place and form the bun. The resulting "pony bun" of FIG. 8 is produced.

Figure 9:
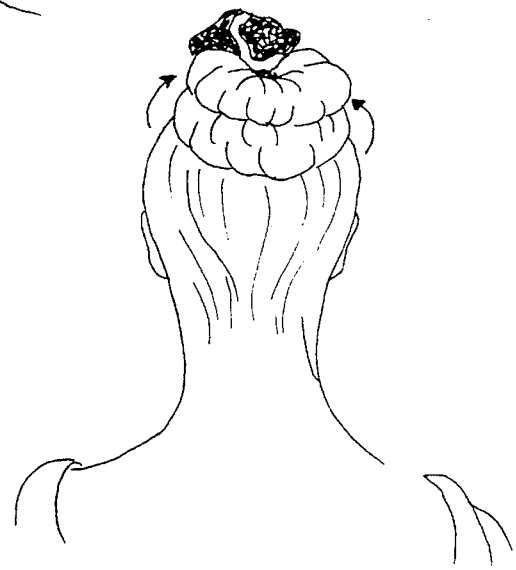
Figure 10:
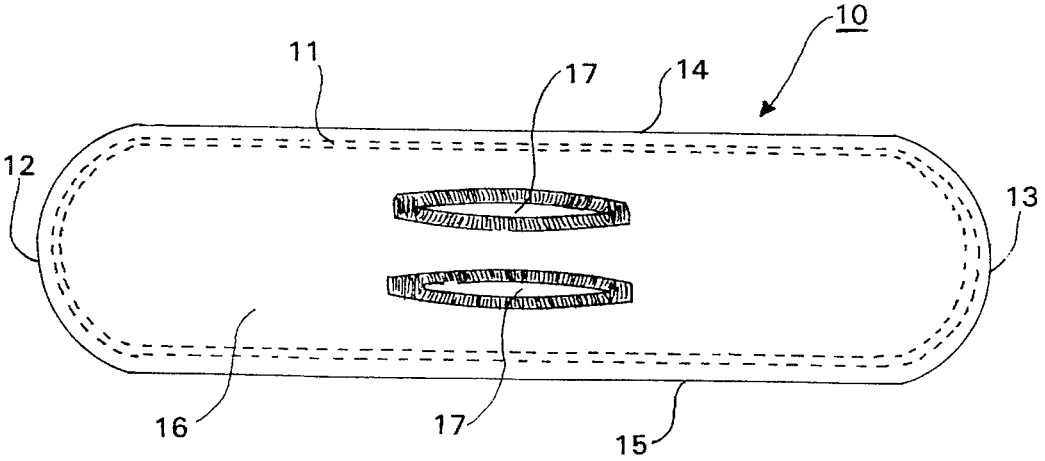
FIG. 10 shows an alternative embodiment of the invention comprising two openings.

FIG. 9 shows still another variation in the use of the inventive implement in which two implements are used to form a "double bun". First, a top section of the hair is inserted into the opening 17 in a first implement. The hair is then rolled over or under the implement until the hair is taut. The ends 12 and 13 of the implement 10 are then crossed over one another and twisted together to secure the implement in place and form the top bun. A second implement is then used for rolling the bottom section of hair and forming the bottom bun by twisting the ends 12 and 13 of the second implement together as was done to form the top bun.

With all the methods of use, removal of the implement involves untwisting and disentwining the opposite ends thereof and then carrying out the styling steps in reverse.

As previously mentioned, it is still possible to use the implement even if the opening is too large for the section of hair to be styled, by twisting the ends in opposite directions, thereby to close up the opening somewhat. This twisting may also be required when styling layered hair.

Instead of the body being only a relatively thin frame, it could instead be of greater extent, i.e., of substantially the same size as its covering, having an opening therethrough aligned with the opening in the covering. It would however still be of flexible material to enable the steps of crossing the ends 12 and 13 and twisting them together to be carried out.

In a further method of use of the implement, the whole of the combed section of the user's hair is received through the opening 17 and the implement is drawn fully up to the nape of the neck by pulling the hair through the opening. The ends of the implement are then crossed around the pony tail formed by the implement being positioned at the nape of the neck. Finally, the crossed sides of the implement are "scrunched" together into the form of a ball at the woman's neck, i.e., at the top of the pony tail. This method of use of the implement is outside the scope of the invention.

While various embodiments of the present invention have been described in detail, it is apparent that modifications, extensions, adaptations and optimizations may occur to those skilled in the art. It is to be expressly understood that such modifications and adaptations and so on are within the spirit and scope of the present invention, as set forth in the following claims.

We claim:

1. A decorative hair styling implement for producing a variety of hair styles comprising:

an outer covering spanning all sides of said implement, wherein said outer covering comprises a top layer and a bottom layer, said outer covering comprised of flexible material allowing for bending, twisting and bowing of the implement into a variety of shapes;

a body located within said outer covering, said body providing a contoured shape to said implement wherein said body is comprised of flexible, pliable material allowing for bending, twisting and bowing of the implement into many different contoured shapes without breaking and wherein said body exhibits little tendency to return itself to its former shape; and a slit within said implement extending completely through said top and bottom layers of said outer covering wherein sections of hair may be passed through said slit, said slit capable of completely encompassing hair passed therethrough, and wherein said slit is not formed by the shape of said body.

2. The implement of claim 1 wherein said implement is of a generally flat rectangular configuration of narrow thickness and wherein said body is located within said covering along the outer periphery of said generally flat rectangular configuration to form a loop, said slit positioned generally near the center of said loop.

3. The implement of claim 2 wherein the outer covering material is a decorative fabric and wherein said body is a bendable material.

4. The implement of claim 3 wherein said outer covering is stitched along the periphery thereof to form a tubular pocket within which said wire is secured in place.

5. A method of using the hair styling implement of claim 1 including the steps of:

holding said implement in a generally horizontal plane, passing a section of hair through said slit and placing said implement near the end of said section of hair;

rolling said implement upwardly until the hair is taut; and crossing a first end and a second end of the implement and twisting said first and second ends together to secure the implement in place and form a bun hairstyle.

6. The method of claim 5 wherein the section of hair used in forming the bun is a top (outer) section of hair, and further including the steps of:

holding a second implement in a generally horizontal plane and passing a bottom (inner) section of hair through the slit in the second implement;

placing said second implement near the end of said bottom section of hair;

rolling said implement upwardly until the hair is taut; and crossing a first end and a second end of the second implement to secure the second implement in place and form a second bun around the first bun to provide a double bun hairstyle.

7. A method of using the hair styling implement of claim 1 including the steps of:

holding said implement in a generally horizontal plane and passing a first section of hair through the slit in said implement;

placing said implement near the end of said first section of hair;

rolling said implement upwardly until the hair is taut;

lifting a second section of hair upwardly over the rolled hair; and crossing a first end and a second end of the implement to secure the implement in place and form a pony loop.

8. A method of using the hair styling implement of claim 1 including the steps of:

holding said implement in a generally horizontal plane and passing a section of hair through the slit in said implement;

placing said implement about half way between the scalp and the end of said section of hair;

rolling said implement upwardly until the hair is taut; and crossing a first end and a second end of the implement to secure the implement in place and form a pony bun.

9. A decorative hair styling implement for producing a variety of hair styles comprising:

an outer covering encompassing all sides of said implement, said outer covering comprised of flexible material allowing for bending, twisting and bowing of the implement into a variety of shapes;

a body located within said outer covering, said body providing a contoured shape to said implement wherein said body is comprised of flexible, pliable material allowing for bending, twisting and bowing of the implement into many different contoured shapes without breaking and wherein said body exhibits little tendency to return itself to its former shape; and a plurality of openings within said implement extending completely through said covering wherein sections of hair may be passed through said openings, said openings capable of completely encompassing hair passed therethrough.

* * * * *